United States Patent [19]

Pulichino, Jr.

[11] Patent Number: 4,925,021

[45] Date of Patent: May 15, 1990

[54] THREE-SECTION SUITCASE

[75] Inventor: John V. Pulichino, Jr., Providence, R.I.

[73] Assignee: American Tourister, Inc., Warren, R.I.

[21] Appl. No.: 371,107

[22] Filed: Jun. 26, 1989

[51] Int. Cl.[5] ..... A45G 5/12; A45G 13/00

[52] U.S. Cl. ..... 206/279; 190/109; 190/111; 190/112; 190/903

[58] Field of Search ..... 206/279-299; 190/109, 111, 112, 903, 120

[56] References Cited

U.S. PATENT DOCUMENTS

| | | | |
|---|---|---|---|
| 1,760,098 | 5/1930 | Wilt | 206/292 |
| 1,913,021 | 6/1933 | Butterick . | |
| 1,954,607 | 4/1934 | Wheary et al. . | |
| 2,001,156 | 5/1935 | Ritter, Jr. . | |
| 2,080,645 | 5/1937 | Wheary | 206/279 |
| 2,131,583 | 9/1938 | Crotty et al. | 190/111 X |
| 2,461,216 | 2/1949 | Kleber | 206/298 |
| 2,893,523 | 7/1959 | Mitchell | 190/903 |
| 2,918,997 | 12/1959 | Kotkins . | |
| 3,447,649 | 6/1969 | Kish, Jr. | 190/111 |
| 3,613,843 | 10/1971 | Davis | 190/903 |
| 3,971,458 | 7/1976 | Koenig | 190/903 X |
| 4,418,804 | 12/1983 | Bradley et al. . | |
| 4,662,513 | 5/1987 | King et al. | 206/298 X |
| 4,693,368 | 9/1987 | King et al. | 190/112 X |
| 4,753,342 | 6/1988 | Pulichino, Jr. et al. | 206/292 X |

FOREIGN PATENT DOCUMENTS

| | | | |
|---|---|---|---|
| 151832 | 12/1937 | Austria | 206/289 |
| 857848 | 12/1952 | Fed. Rep. of Germany | 206/298 |
| 644100 | 5/1928 | France | 206/292 |
| 348355 | 2/1935 | United Kingdom . | |
| 898062 | 6/1962 | United Kingdom | 190/111 |

*Primary Examiner*—William Price

*Attorney, Agent, or Firm*—Wood, Herron & Evans

[57] ABSTRACT

A soft luggage-type suitcase having three compartments enclosed by panels or lids hinged to a container having top, bottom and side walls. One of the compartments is closed by a lid having a wide rim at its free end and a narrow rim forming a hinge of the lid to the container. A diagonal rim connects the narrow rim to the wide rim. A universal hanger is connected to the wide rim. An extender panel is hinged to the top wall of the container and cooperates with the lid and universal hanger for the packing of long garments.

10 Claims, 2 Drawing Sheets

THREE-SECTION SUITCASE

BACKGROUND OF THE INVENTION

This invention relates to soft luggage and particularly to a large, generally rectangular suitcase sometimes referred to as a pullman case.

It is known to provide a suitcase formed of a rectangular container having a central divider which creates two compartments. A lid on each side of the container is hinged along one edge to one wall of the container and closed on the container with a slide fastener passing around the remainder of the perimeter of the lid. The corners of this container are formed and supported by somewhat flexible plastic corner members, each of which extends through an arc of about 90°.

The lid has been a "rail zipper," that is, a flat lid having only enough fabric rim (about ½ inch) to support a slide fastener. The rail zipper is easy to manipulate and popular with customers. The lid has also been formed with a wide rim (about 1½–2 inches in width). Such a wide rim must have corner supports similar to the stiff corners on the container. The wide rim provides a place for a hanger bracket at the free edge of the lid and, hence, is desirable from the standpoint of laying out garments from hangers at the edge of the open lid, the garments being laid across the lid and container and folded upon themselves by closing the lid. The customer, however, does not like pulling a zipper around the stiff corners of the rim where the lid is hinged to the container. There is a certain awkwardness there occasioned by the slide tending to jam as it makes the excursion around the rigid corner-forming member on the lid.

SUMMARY OF THE INVENTION

An objective of the present invention has been to provide, in a soft luggage suitcase, a lid with a hanger bracket on the free edge but without the zippering problems that are encountered with lids having wide rims.

This objective of the invention is attained by providing a lid that has substantially no rim at the edge where the lid is hinged to the bottom wall of the container while having a wide rim at the opposed free edge of the lid. The slide fastener, to interconnect the wide rim with the narrow rim, extends diagonally from the wide free edge to the narrow hinged edge.

The wide free edge preferably has a rigid reinforcing band with arcuate corners. A hanger bracket, preferably a universal bracket that accepts the conventional type of wire hanger, is fixed to the center of the wide rim at the free edge of the lid.

Through the structure described above, the customer thus has the advantages of a wide rim with hanger bracket at its free edge and a narrow rim without a rigid corner form where the lid is hinged to the suitcase container, thus providing ease of slide fastener manipulation.

Another feature of the invention is in the provision of a length extender panel hinged to the container bottom wall, the length extender panel folding outwardly in direction opposite to the opening of the lid with respect to the container. When the lid is fully open and the extender panel has been swung through 180° to an open position, a garment mounted on a hanger can be laid across the lid, the container and the extender panel and thereafter twice folded upon itself.

Thus, the extender panel creates the opportunity to use a universal hanger bracket on the rim of the lid, the universal bracket receiving the conventional wire hanger. The conventional wire hanger spaces the garment 2–3 inches away from the rim and is therefore unacceptable in a conventional suitcase. However, with the extender panel, the universal hanger bracket with the use of conventional hangers is made possible. This in turn opens up corner areas adjacent the universal hanger for the mounting of triangular pockets of the type shown in connection with the garment organization of U.S. Pat. No. 4,753,342. That organization is of course taught in U.S. Pat. No. 4,753,342 but is believed to be novel in a suitcase and, as indicated above, is made feasible for the first time by the extender panel.

Another feature of the invention has been to provide a three-compartment suitcase, each compartment being separately accessible by means of a conventional slide fastener around three sides of each compartment.

BRIEF DESCRIPTION OF THE DRAWINGS

The several features of the present invention will become more readily apparent from the following detailed description taken in conjunction with the accompanying drawings in which.

DETAILED DESCRIPTION OF THE INVENTION

Figure 1:
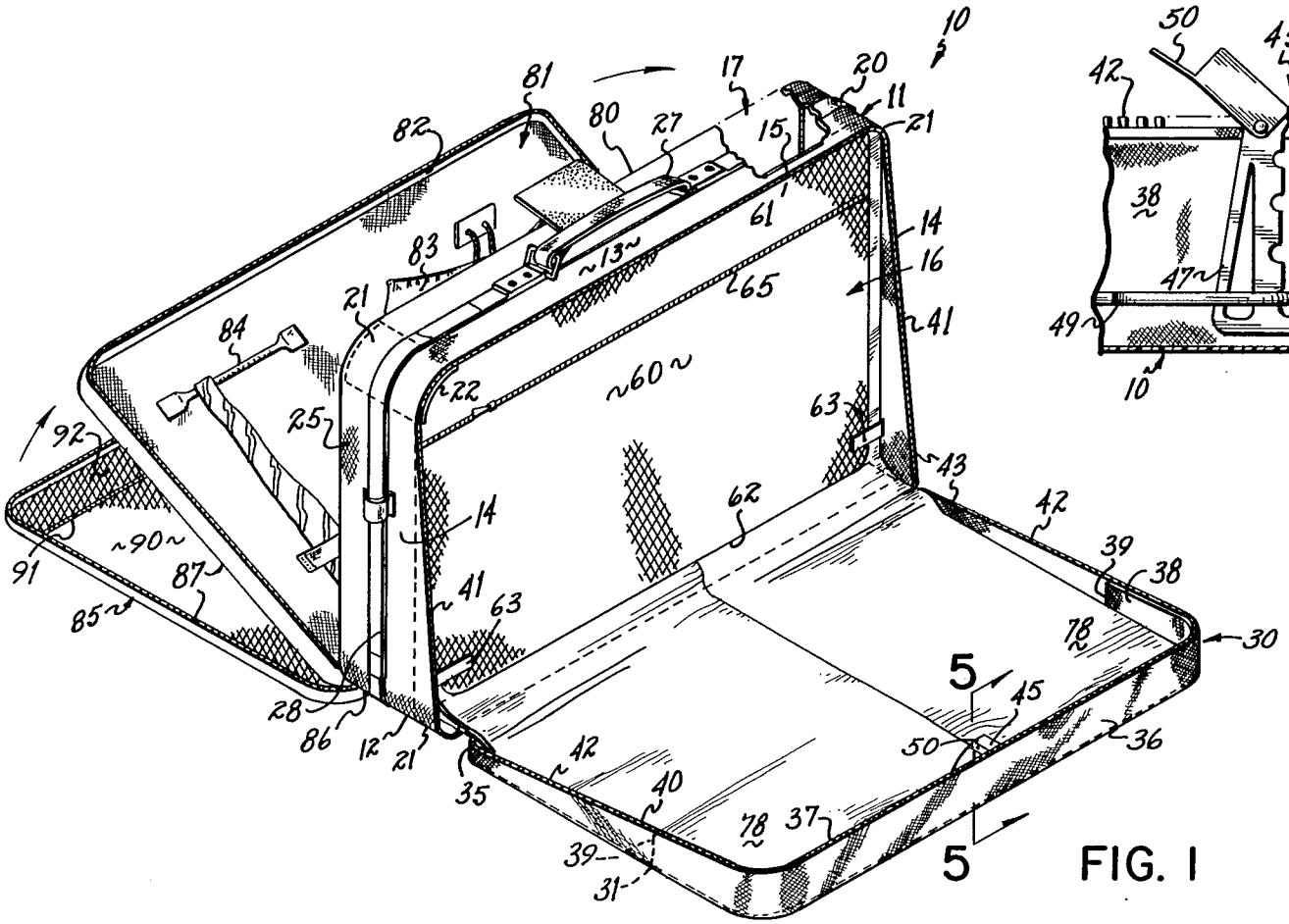
FIG. 1 is a perspective view of a suitcase of the present invention in open condition.
Figure 4:
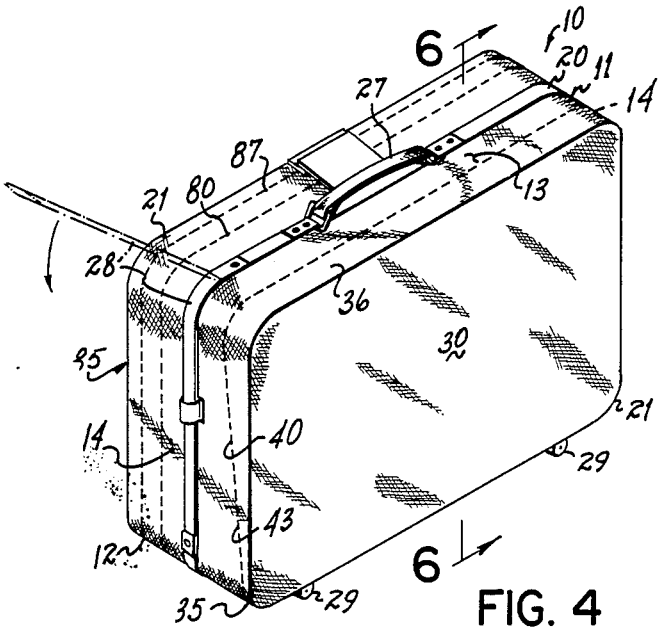
FIG. 4 is a perspective view of the suitcase in a closed, condition.
Figure 6:
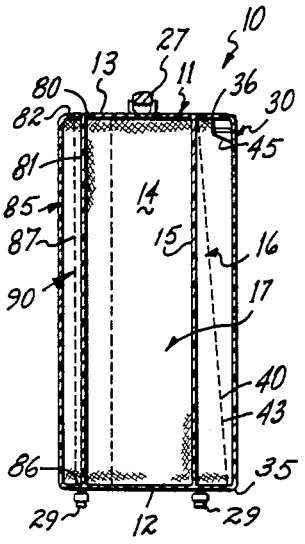
FIG. 6 is a cross-sectional view taken along lines 6—6 of FIG. 4.

Referring to FIGS. 1 and 4, the suitcase of the present invention is indicated at 10 and has as a principal element a rectangular container 11. The rectangular container has a bottom wall 12, a top wall 13, and side walls 14. The container 11 has a central divider 15 which divides the container into a relatively thin hanging garment compartment 16 and a wider clothes compartment 17 (as shown in FIGS. 1 and 6). A rigid rectangular band 20 extends around the container to support it on its rectangular form. At the corners 21, rigid, slightly flexible corner-forming elements 22 are secured to the container 11 to hold the fabric 25 which encloses the container from collapsing against the central band 20. A handle 27 is riveted to the central band 20 for carrying the suitcase. A strap 28 is connected to the central band is adapted to be pulled away from the central band and used as a tether for pulling the suitcase on its casters 29.

The lid 30 is formed of a fabric and supported by a thin perimeter rod 31 which is stitched into the fabric. The lid 30 is hinged by fabric of about ½ inch width to the container 11 at the bottom wall 12. The hinge is formed by a thin rim section 35. The lid 30 has a free edge 36. A wide rim 37 extends across the free edge and is supported by a U-shaped rigid band 38 that extends to about the position 39. Between the wide rim 37 and the narrow rim 35 at the hinge, the rim presents a diagonal edge 40 by which the wide rim tapers to the narrow rim. The container 11 presents an edge 41 which mates with the edge 42 formed by the rim and a slide fastener 43 joins the mating edges together to close the lid on the clothes compartment 16.

Figure 5:
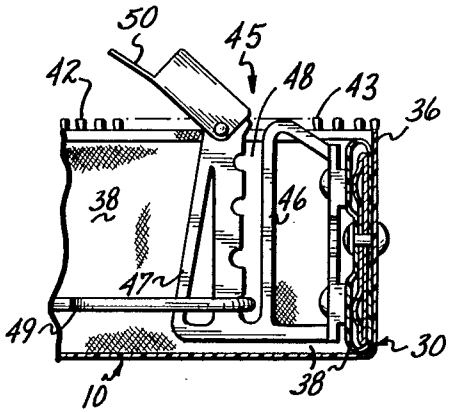
FIG. 5 is a cross-sectional view of the hanger bracket taken along lines 5—5 of FIG. 1.

The wide rim portion 37 provides a surface for accommodating a universal hanger bracket 45 as shown in FIG. 5. The hanger bracket is riveted to the rigid band 38. It has two spaced arms 46 and 47 which present a space 48 into which a clothes hanger 49 can be slid. A cap 50 is pivotally mounted on the arm 47 and adapted to bridge the space 48 and latch against arm 46 to hold the hangers in the space 48.

An extender panel 60 is hinged at 61 to the top wall 13 of container 11. The extender panel 60 has a free edge 62. A pair of straps 63 connected to opposed side walls 14 normally hold the free end of the extender panel 60 in the closed position shown in FIG. 1. Hook and loop fasteners (Velcro) between the straps and panel 60, respectively, are provided. The panel 60 may be of a mesh fabric and may have a zippered opening 65 for carrying thin garments.

Figure 2:
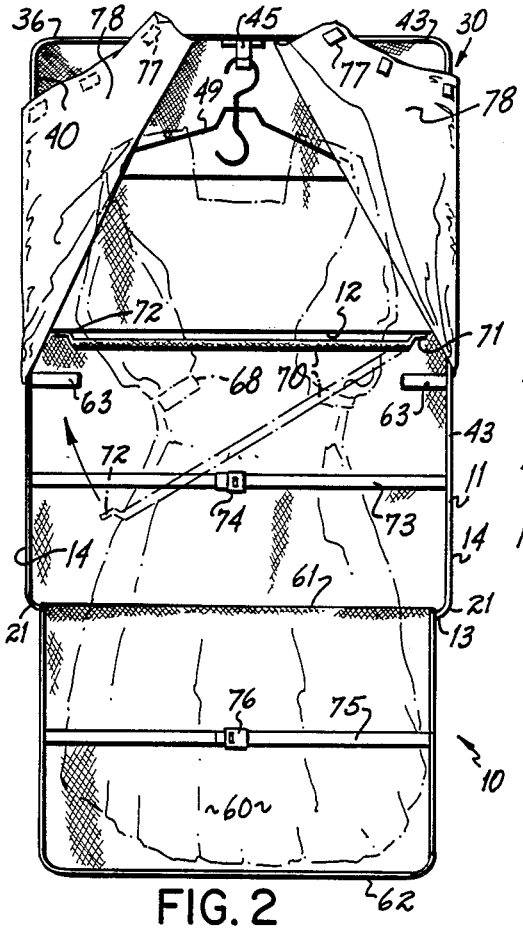
FIG. 2 is a plan view of the suitcase with a garment mounted in it ready for folding.

When the extender panel 60 is flipped around its hinged edge at 61 through 180°, it lies with respect to the container 11 as illustrated in FIG. 2. Similarly, when the lid 30 is flipped through 180°, it lies with respect to the container 11 as shown in Fig. 2. A garment 68 is shown hanging on a hanger 49, the hanger being mounted on the hanger bracket 45. A bar 70 is connected by a strap 71 to one side of the bottom wall 12 of the container. The free end is removably attached by a hook and loop fastener 72 to the bottom wall 12. The bar 70 can be laid over the garment as shown in solid lines in FIG. 2 to minimize creasing when the lid is folded from the position shown to a closed position of FIG. 4.

A strap 73 having a separable fastener 74 is available to hold the garment in the container 11. A similar strap 75 with a separable fastener 76 holds the end of the garment against the extender panel 60. Two flexible wrapper elements 77 may be stitched to the container for enclosing the garment and minimizing wrinkling.

When the garment is thus laid out as shown in FIG. 2, there is ample room in lid areas at the outer corners indicated at 78 for mounting corner pockets, thus adding to the usable space within the suitcase. The combination of hanger bracket, conventional hanger and corner pockets is shown in U.S. Pat. No. 4,753,342 in a garment bag environment.

Figure 3:
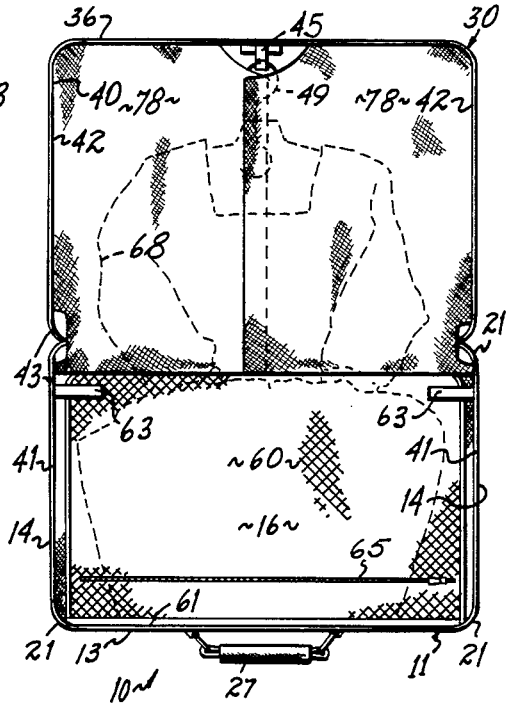
FIG. 3 is a view similar to FIG. 2 with the garment partly folded.

To fold the garment in the suitcase, the extender panel 60 is folded into the suitcase as shown at FIG. 3 and held there by the straps 63. The lid is closed as shown in FIG. 4, making the final fold of the garment into the relatively shallow compartment of the suitcase.

The larger compartment 17 has an opening 80 which is closed by a middle panel 81. A slide fastener on a very thin rim 82 is provided to cooperate with mating elements on the compartment 17 to close the compartment 17. It may be desired to have a lock on that compartment 17. It can been seen that the middle panel 81 can be provided with a pocket 83 for shoes and the like and a rack 84 for ties. An outside panel or lid 85 is hinged at 86 to the bottom wall 12 opposite the lid 30. It has a slide fastener 87 cooperating with the middle panel 81 to close the suitcase while forming yet another thin compartment 90. Thus, the suitcase of the present invention provides three major compartments, each enclosed by a hinged lid or panel and a slide fastener at the edge of the lid or panel for closing the respective compartment. The third compartment 90 may be accessible through a zipper 91 formed in the fabric 92 that forms the outside of the lid 85. Thus, that compartment could be used for last minute items that need to be tucked into the suitcase after it has been fully packed and substantially closed.

In the operation of the invention, garments such as a dress or a suit on a conventional hanger, are laid out across the lid 30 container 11 and extender panel 60 as shown in FIG. 2. The bar 70 is laid across the garment. The straps 73, 75 are fastened across the garment. The extender panel is folded into the container 11 as shown in FIG. 3. The lid 30 is swung across the container 11 and zippered to close it as shown in FIG. 4. By providing a thin reinforced fabric hinge for the lid 30, the slide fastener 43 is very easily zipped to a closed position. At the same time, however, a wide reinforced rim is available for the hanger bracket 45.

Major items to be packed are assembled in the large compartment 17. The middle panel is then fastened to the container 11 to close the large compartment. Small thin items may be packed in the thin compartment 90, or it may simply be left available for packing last minute items.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A suitcase comprising, a generally rectangular container having a bottom wall, top wall, end walls, parallel side walls, and a central divider generally parallel to said side walls, a lid forming one of said side walls of said container, means for hingedly connecting said lid along one edge to said bottom wall, a slide fastener for connecting the remaining edges of said lid to said end and top walls, said lid having a top edge and a wide top rim projecting from said top edge, said rim being terminated at its edge by said slide fastener, said lid having side edges and, on each side edge, a side rim tapering from said wide top rim to said hinge adjacent the bottom edge of said lid, where said side rim is narrow, whereby closing said slide fastener around corners adjacent said hinge connection is facilitated.

2. A suitcase which is rectangular in transverse cross section comprising, a container having generally parallel side walls, and a central divider parallel to said side walls, and a rectangular edge forming an opening, a container rim around said edge, a lid forming one of said side walls and hinged to said container rim and having a lid rim around its perimeter, slide fastener means on said container rim and said lid rim, respectively, for joining said rims together to close said container, the slide fastener extending diagonally across the sides of said rims so that said lid rim is narrow where hinged to wide container rim, and wide at the free edge of said lid.

3. A suitcase as in claim 2 further comprising a universal hanger bracket fixed to the free edge of said lid within said lid rim, said universal bracket accepting conventional wire hangers, whereby garments can extend across said lid and container.

4. A suitcase as in claim 3 further comprising, a folding bar mounted across said container adjacent the hinge connection of said lid to said container, said folding bar minimizing creasing of clothes when said lid is closed, said folding bar being pivotably fixed at one end to said container and releasably secured at the other end to said container.

5. A suitcase comprising, a container having a top wall, bottom wall and end walls, a lid hinged to said bottom wall and having a free edge, a hanger bracket mounted on the free edge of said lid, and an extender panel hinged to said top wall, whereby, when said lid is opened in one direction and said panel is swung in the opposite direction, a garment can be hung from said hanger bracket and laid across said lid, container and extender panel.

6. A suitcase as in claim 2 further comprising, a rigid reinforcement extending across the wide portion of said lid rim and around its corners, a rigid reinforcement across the wide portion of said container rim where said lid is hinged to said container rim.

7. A suitcase comprising, a central section having a top wall, a bottom wall, and side walls forming a container, a central panel across said container, a lid hinged to said bottom wall at one side of said container thus forming a first compartment, a slide fastener mounted between said lid and said container, a middle panel hinged to said bottom wall at the other side of said container thus forming a second compartment, a panel slide fastener mounted between said middle panel and said container to form a closable middle compartment between said middle and central panels, an outside panel hinged to said bottom wall adjacent said middle panel thus forming a third compartment, and a third slide fastener mounted between said outside and middle panels to create an outside compartment between said outside and middle panels.

8. A suitcase as in claim 7 further comprising, a slide fastener across said outside panel permitting limited access only to said outside compartment.

9. A suitcase as in claim 7 further comprising, said lid having a free edge, a hanger bracket mounted adjacent said free edge, and an extender panel hinged to said top wall, whereby, with said lid and extender panels extending in opposite directions, a garment can be laid across said lid, said container, and said extender panel.

10. A suitcase comprising, a container having a rectangular edge forming an opening, a container rim around said edge, a lid hinged to said container rim and having a lid rim around its perimeter, slide fastener means on said container rim and said lid rim, respectively, for joining said rims together to close said container, the slide fastener extending diagonally across the sides of said rims so that said lid rim is narrow where hinged to wide container rim, and wide at the free edge of said lid, a universal hanger bracket fixed to the free edge of said lid within said lid rim, said universal bracket accepting conventional wire hangers, whereby garments can extend across said lid and container, a length extender panel hingedly connected to said container rim opposite said lid hinge, a strap across said extender panel to hold a garment to said panel, whereby when said lid is open, a garment can be laid across said lid, said container and said extender panel prior to folding said extender panel within in said container and fastening said lid on said container.

* * * * *